US007331095B2

(12) United States Patent
Furchheim

(10) Patent No.: US 7,331,095 B2
(45) Date of Patent: Feb. 19, 2008

(54) METHOD OF HYDROFORMING A WORKPIECE

(76) Inventor: Bodo Furchheim, Otto-Thoerner-Strasse 53, D-09127 Chemnitz (DE)

( * ) Notice: Subject to any disclaimer, the term of this patent is extended or adjusted under 35 U.S.C. 154(b) by 447 days.

(21) Appl. No.: 10/819,242

(22) Filed: Apr. 6, 2004

(65) Prior Publication Data

US 2005/0015952 A1 Jan. 27, 2005

Related U.S. Application Data

(63) Continuation of application No. PCT/DE02/03746, filed on Oct. 4, 2002.

(30) Foreign Application Priority Data

Oct. 11, 2001 (DE) ..... 101 50 092

(51) Int. Cl.
*B23P 17/00* (2006.01)

(52) U.S. Cl. ..... 29/421.1; 29/467; 29/468; 29/888.1; 72/61

(58) Field of Classification Search ..... 29/421.1, 29/523, 888.1, 522.1, 466, 467, 468; 72/61, 72/57, 58
See application file for complete search history.

(56) References Cited

U.S. PATENT DOCUMENTS 4,660,269 A * 4/1987 Suzuki ..... 29/523
5,220,727 A * 6/1993 Hochstein ..... 29/888.1
5,570,507 A * 11/1996 Hochstein ..... 29/888.1
6,286,196 B1 * 9/2001 Vogel ..... 29/421.1

FOREIGN PATENT DOCUMENTS

DE 36 43 803 A1 6/1988
DE 198 42 318 A1 3/2000
DE 199 55 285 A1 5/2001

* cited by examiner

*Primary Examiner*—Jermie E. Cozart
(74) *Attorney, Agent, or Firm*—Harness, Dickey & Pierce, P.L.C.

(57) ABSTRACT

The invention concerns a method whereby components are arranged in a mounting device, outside an internal high-pressure forming press, in accordance with their position and their function, such that they are linked to one another. The mounting device comprises an upper part and a lower part including cavities identical to the cavities of the internal high pressure tool. Once the components have been installed, the mounting device is introduced in the internal high-pressure press, then the upper part or the lower part of the mounting device is withdrawn, the part of the mounting device remaining in the internal high-pressure press being displaced against the upper tool or the lower tool. For the forming process, the components are maintained in a part of the tool by depression or by clamping, then the part of the mounting device is removed from the internal high-pressure press, thereby ensuring high precision positioning of components. Additionally, the production rate is substantially increased. The invention is particularly applicable for the production of cam shafts.

4 Claims, 3 Drawing Sheets

METHOD OF HYDROFORMING A WORKPIECE

CROSS REFERENCE TO OTHER APPLICATIONS

The present application is a continuation of pending international patent application PCT/DE02/03746, filed Oct. 4, 2002 which designates the United States and was published in German, and which claims priority of German patent application 101 50 092.0, filed Oct. 11, 2001.

BACKGROUND OF THE INVENTION

The invention relates to a method for feeding hydroforming presses (internal high pressure forming presses) in order to produce workpieces which are composed of a plurality of parts, preferably camshafts, in a hydroforming process which is known per se. The hydroforming process is used to nonpositively and positively connect cam rings and also other components, such as drive elements, to one another. The hydroforming press which carries out the method is equipped to receive at least one workpiece, i.e. a camshaft which comprises a hollow shaft with the cam rings which are to be applied to it.

The hydroforming process generally changes the geometry and dimensions of workpieces which are hollow through the action of a pressurized medium (air, liquid). These axial forces deform the workpiece to the extent which is predetermined by the mold, also known as the mold nest, in the hydroforming press.

Hydroforming presses of this type have two dies, a lower die and an upper die, the mold nests of which, in the closed state, correspond to the shape of the overall workpiece, the camshaft with the cam rings arranged appropriately. In general, the die is parted in the center.

There are various known designs of hydroforming processes and their dies, but these all operate according to the same principle. The workpieces which are to be treated are put in place and the internal pressure deforms them. It is preferable to produce rotationally symmetrical workpieces. The process itself, the hydroforming operation, takes place in an extremely short time, but the ancillary times, in particular the feeding of the hydroforming press, are lengthy, which ultimately means that the cycle time is long.

It has already been attempted to produce camshafts from a hollow shaft and cam rings secured to it. In this case, the loading time is very long, since the cam rings have to be placed very accurately in their position, i.e. in accordance with their subsequent function, and their position (angular position) must not change as a result of the shaking and vibrations which occur in the hydroforming press. An additional factor is that the position of some cam rings, on account of their shape, is very labile, and in particular these rings are at risk of changing position. Even if a correct, functionally appropriate position of the cam rings is checked using gauges or other checking means after they have been placed into the hydroforming press, it is impossible to rule out the possibility of the position changing when the die is closed. A change in position of just one cam ring has serious consequences. The cam rings are hardened, and if they are incorrectly positioned in the mold nest they will destroy the die and will also be damaged themselves, rendering them unusable. Since the dies are very expensive, damage of this nature is to be ruled out at all costs. Since the aim is to increase the productivity of hydroforming processes, the dies are also designed in such a way that they receive a plurality of workpieces. Of course, there are limits on this expansion, since the supply and control of the pressurized medium entails further measures and increased outlay, which in turn increases the costs of the hydroforming press and ultimately also the process costs.

These drawbacks do not occur to such an extent in the case of deformation of simple, rotationally symmetrical workpieces, but do so more with complicated workpieces, such as camshafts, which on account of their function require a very high degree of accuracy. Slight changes in the position of cam rings even just as a result of the force of gravity, which has a particularly critical effect in connection with machine vibrations when the cam rings are positioned with the tip of the cam facing upward and in an angle which deviates from the vertical, have to be eliminated, and this is almost impossible with the known methods used to feed the hydroforming press.

DE 36 43 803 A1 discloses an assembly apparatus for assembled camshafts, and assembly methods. The document discloses a mounting apparatus for assembled camshafts, having a holding apparatus for axially fixing individual elements, such as cam disks, bearing seats or gearwheels, and a pressure-medium sensor for hydraulically widening a hollow shaft in sections in which the elements and the hollow shaft are connected to one another in a nonpositive manner. Individual fixing disks are provided for the holding apparatus, each having a central opening for receiving one of the elements, such as cam disks, bearing seats or gearwheels, and an external bearing seat for being received in each case in one bearing location of the holding apparatus. The individual elements can be fixed at the appropriate angle prior to mounting by means of these fixing disks, while the hollow shaft can execute radial movements with respect to the individual elements. This known mounting apparatus therefore comprises a lower part and an upper part, with identical mold nests for receiving parts being formed in the lower part and upper part and the lower part and upper part being connected in an accurately fitting manner. Positioning elements are arranged on the upper and lower parts at the locations in the upper part and/or lower part where it is necessary to secure the parts in position, these positioning elements ensuring that the upper and lower parts are connected to one another in an accurately fitting manner.

Furthermore, the laid-open specification cited above discloses a method for assembling a camshaft. In this method, all the parts of the camshaft are placed into the lower part of a mounting device, which comprises a lower part and an upper part, in a positionally and functionally correct manner; the spatial and functionally correct position of the parts is checked; the upper part of the mounting device is placed onto the lower part; the parts are nonpositively and positively connected in the predetermined position in the mounting device by clamping; the upper part of the mounting device is then, together with the parts held therein, put down on the lower die in the precisely defined position by means of positioning elements.

The invention is based on the object of providing a method for feeding hydroforming presses which allows a workpiece which is not rotationally symmetrical and is composed of a plurality of individual parts, preferably a camshaft, to be produced in a known hydroforming process, while ensuring the high degree of accuracy required with regard to the position of the cam rings. Furthermore, it is intended to significantly reduce the ancillary time required to feed the hydroforming press, in order to increase the productivity of the method and of the hydroforming presses. A further increase is also to be made possible by virtue of the method being configured in such a way that a plurality of workpieces can be produced in a single cycle. The method is intended to rule out the possibility of the workpiece and/or parts thereof and the hydroforming press being destroyed or damaged.

The basic structure and operation of the hydroforming press are to be retained and matched to the method according to the invention without any significant increase in costs. The device for carrying out the method is to form part of the hydroforming process, i.e. it is to be functionally connected to the hydroforming press in such a manner that the overall hydroforming process can be carried out more economically. The device is to form an indirect part of the hydroforming press and is to be used directly for carrying out the method.

SUMMARY OF THE INVENTION

According to the invention, the object is achieved, in terms of a first method, by means of a method for feeding hydroforming presses with a plurality of parts, which are nonpositively and positively connected to one another by the hydroforming process to form a workpiece, preferably to form a camshaft which is composed of a hollow shaft and cam rings, comprising the steps of

- all the parts of the workpiece are placed into the lower part of a mounting device, which comprises a lower part and an upper part, in a positionally and functionally correct manner,
- the spatial and functionally correct position of the parts in the lower part of the mounting device is checked,
- the upper part of the mounting device is placed onto the lower part, with the result that at the same time a final check on the spatial and functionally correct position of the parts is carried out, and the mounting operation is concluded only if there is no deviation,
- the parts are held in the predetermined position in the upper part of the mounting device by clamping and/or suction,
- the loaded upper part of the mounting device is moved into the open hydroforming press between the upper die and lower die or toward the lower die,
- the upper part of the mounting device, together with the parts which are held securely therein, is put down on the lower die in a precisely defined position by means of positioning elements,
- by releasing the clamps and/or lowering the suction pressure, the parts are held in the lower die in a positionally and functionally correct manner as a result of the lower die taking over the position-securing function,
- the upper part of the mounting device is conveyed out of the hydroforming press or is removed from the lower die,
- the hydroforming die is closed and the hydroforming process is carried out in a known way, and
- after the hydroforming process has ended, the finished workpiece is removed.

According to a second aspect of the invention, the object is achieved by a method for feeding hydroforming presses with a plurality of parts, which are nonpositively and positively connected to one another by the hydroforming process to form a workpiece, preferably to form a camshaft which is composed of a hollow shaft and cam rings, comprising the steps of

- all the parts of the workpiece are placed into the lower part of a mounting device, which comprises a lower part and an upper part, in a positionally and functionally correct manner,
- the spatial and functionally correct position of the parts in the lower part of the mounting device is checked,
- the upper part of the mounting device is placed onto the lower part, with the result that at the same time a final check on the spatial and functionally correct position of the parts is carried out, and the mounting operation is concluded only if there is no positional deviation,
- the parts are held in the predetermined position in the lower part of the mounting device by clamping and/or suction,
- the loaded lower part of the mounting device is moved into the open hydroforming press between the upper die and lower die or toward the upper die,
- the upper part of the mounting device is lifted off and removed from the hydroforming press or from the lower die,
- the lower part of the mounting device, together with the parts which are held therein, is moved onto the upper die in a precisely defined position by means of positioning elements and is closed in an accurately fitting manner to the upper die,
- the parts are held in the upper die by means of clamping and/or suction, and at the same time in the lower part of the mounting device, the clamps are released and/or the suction pressure is lowered,
- the lower part of the mounting device is removed from the hydroforming press,
- the hydroforming die is closed and the hydroforming process is carried out in a known way,
- after the hydroforming process has ended, the finished workpiece is removed.

According to a third aspect of the invention, the object is achieved by a method for feeding a hydroforming press with a plurality of parts, which are nonpositively and positively connected to one another by the hydroforming process to form a workpiece, preferably to form a camshaft which is composed of a hollow shaft and cam rings, comprising the steps of

- all the parts of the workpiece are placed into the lower part of a mounting device, which comprises only a lower part or only an upper part or a lower part and an upper part, in a positionally and functionally correct manner,
- the spatial and functionally correct position of the parts in the mounting device is checked,
- the upper part of the mounting device is placed onto the lower part, with the result that at the same time a final check on the spatial and functionally correct position of the parts is carried out, and the mounting operation is concluded only if there is no deviation in the position of parts,
- the parts are held in the predetermined position in the lower part of the mounting device by clamping and/or suction,
- the loaded lower part of the mounting device is moved toward the upper die in the hydroforming press and is placed onto it in an accurately fitting position,
- the parts are held in the upper die by means of clamping and/or suction, and at the same time in the lower part of the mounting device, the clamps are released and/or the suction pressure lowered,
- the lower part of the mounting device is removed from the upper die, the hydroforming die is closed and the hydroforming process is carried out in a known way, after the hydroforming process has ended, the finished workpiece is removed.

According to another aspect of the invention, the object is achieved, in terms of an apparatus, by a device which, as mounting device, comprises a lower part and an upper part, wherein identical mold nests to those in the lower die and upper die of the hydroforming press for receiving parts which are connected to one another in the hydroforming process are formed in the lower part and upper part, wherein the lower part and upper part are connected in an accurately fitting manner by means of locating pins, wherein passages for holding the parts in place are formed in the upper part and/or lower part at the locations where it is necessary to secure the positions of the parts, wherein the passages are connected to a vacuum pump by means of movable lines, wherein guide elements are connected to the mounting device in such a manner that they allow the mounting device to be conveyed into the hydroforming press between the upper and lower die and allow the lower part and upper part to be separately conveyed out of the hydroforming press, and wherein positioning elements are arranged at the upper and lower part and/or the upper and lower die, ensuring accurately fitting connection between these parts.

According to an advantageous embodiment, the method step of checking the spatial and functionally correct position of the parts in the lower or upper part of the mounting device is dispensed with if the check resulting from the part of the mounting device being placed onto the respective mating pieces of the dies is already able to perform the checking function.

The basic principle of the method consists in taking part of the overall method, i.e. a method step in which one or more workpieces are produced simultaneously, out of the hydroforming method, also known as the cycle. The assembling of the shaft together with the cam rings which are to be fitted to it and are to be connected to one another, as a method step which precedes the actual hydroforming process, is taken out of the cycle in this manner, as a result of all the parts which belong to the finished workpiece being placed in their functionally correct position in a mounting device. This includes not only this positioning operation but also test processes which are matched to the method and workpiece. Then, the positioned parts, having been secured such that they cannot change position in an unacceptable way in the mounting device, are conveyed into the open die in the hydroforming press. The two-part mounting device has the same mold nests for receiving cams and other components which are to be mounted as the die of the hydroforming press.

Clamps and/or suction devices arranged in the upper part of the mounting device ensure that all parts (hollow shaft, cam rings, drive elements) are fixed in place. The upper part is placed onto the lower die of the hydroforming press by means of positioning elements. As a result, in turn, all parts are held fixed in position and surrounded by the mold nests of the upper part of the mounting device and lower die of the hydroforming press. Then, the clamps are released and/or the suction pressure reduced, and the upper part of the mounting device is pushed up; and the upper part is removed from the hydroforming press. Next, the upper die of the hydroforming press is put in place, i.e. the hydroforming press is closed and the actual hydroforming process takes place. In the meantime, further mounting devices have been loaded in an independent sequence, so that a cycle takes place within a very short time.

When the parts are being placed in the mounting device, all the checking functions and securing measures are also carried out, so that when they are introduced into the hydroforming press there is no need to check the position of the parts, or at least the position of the parts only has to be checked in a very cursory fashion, since they are conveyed in such a manner as to be protected from any changes in position.

A further way of achieving the object consists in the parts or assemblies, after they have been put in place and fixed in the mounting device, being held in the lower part of the mounting device, likewise by clamping and/or suction. The mounting device is conveyed into the open hydroforming press and positioned beneath the upper die of the hydroforming press. The upper part of the mounting device is removed and moved out of the hydroforming press. The lower part of the mounting device, together with the parts which are held therein, is lifted onto the upper die of the hydroforming press and the parts are then held in the upper die of the hydroforming press in a functionally correct manner by means of clamping and/or suction. Then, the connection between the parts and the lower part of the mounting device is released and the lower part is moved out of the hydroforming press. The further sequence of the method then takes place as in the method variant which was described first.

To ensure the high degree of accuracy during production of the camshaft in terms of the position of the cam rings on the shaft, it is advantageous to check the position of all the parts before the hydroforming press is closed.

The suction on the parts in the mounting unit and also in the hydroforming die is applied by means of a commercially available vacuum pump, which generates a pressure reduction which corresponds to the weight of the parts which are to be sucked up.

The major advantage of the method according to the invention is that the entire loading operation in the hydroforming press is eliminated, apart from the introduction of the mounting device. Consequently, the cycle time is very greatly reduced and productivity is increased. The use of a plurality of mounting devices makes it possible to provide large numbers for hydroforming. Furthermore, it is ensured that both the parts and the hydroforming die are scarcely ever damaged by incorrect insertion or by changes in position. The mounting device ensures high process reliability, even in the event of a plurality of workpieces being treated in a die or mounting device. The position of the cams in the mounting device is checked by means of known checking means and methods; and a final check before the mounting device is introduced is carried out by establishing, when the upper part is put in place, whether the position of the parts is accurate, since otherwise closure is impossible.

Loading of the mounting device can be carried out manually or automatically.

The device for carrying out the method is a mounting device which is loaded independently outside the hydroforming press and can be moved into the open hydroforming press on guide elements. The guide elements are designed not only to convey the mounting unit into the hydroforming press and back out, but also to fit the mounting device onto the hydroforming dies in a procedurally accurate manner. These guide elements are expediently designed in such a way as to perform the entire movement sequence of the mounting device.

The mounting device comprises a lower part and an upper part. Both parts have the same mold nests as the die lower and upper parts of the hydroforming press.

The upper and lower parts of the mounting device are connected to one another in a readily releasable manner by means of known locating elements. Passages, which are connected to a vacuum generator via flexible lines, are formed at certain locations in the lower part and/or upper part of the mounting device for accurate, immovable positioning of the parts. However, it is also possible for clamping elements, such as for example clips, to be arranged on or in the lower and/or upper part at suitable locations for holding the parts; these clamping elements can easily be opened from the outside if the lower or upper part of the mounting device were to be placed onto the lower or upper die of the hydroforming press.

However, in order to ensure that the parts are held accurately in the hydroforming die, which is necessary in particular if the lower part of the mounting device has been connected to the upper die and then moved out of the hydroforming press, in this embodiment passages, which are likewise connected to a vacuum generator, are formed in the upper die, substantially at the same locations as in the upper part of the mounting device. In the lower die of the hydroforming press, the water-removal passages which are customarily present can be used for this purpose.

BRIEF DESCRIPTION OF THE DRAWINGS

The invention is described on the basis of an exemplary embodiment. In the associated drawing.

DETAILED DESCRIPTION OF A PREFERRED EMBODIMENT

Figure 1:
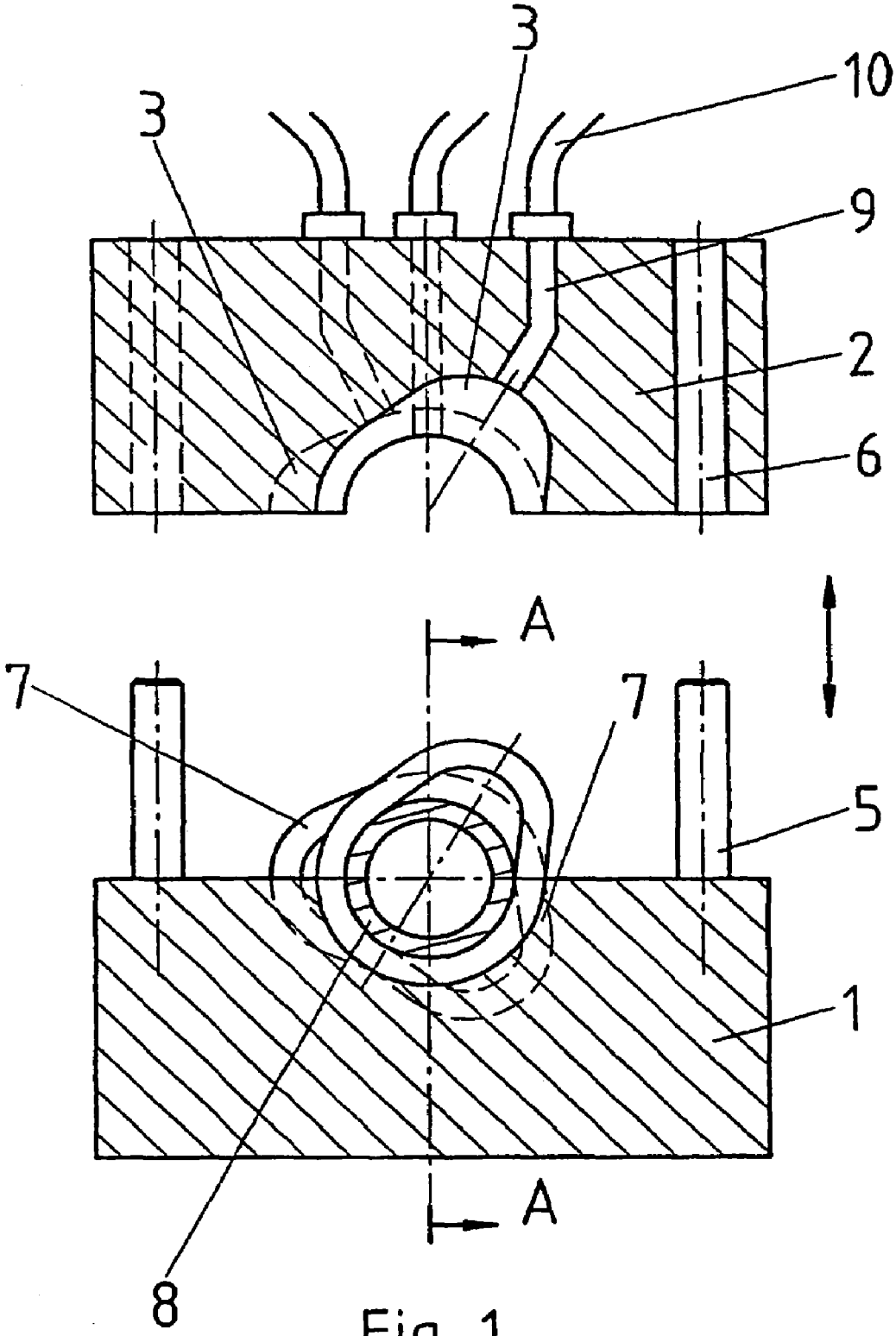
FIG. 1 shows a mounting device in the open state with the inserted parts for a camshaft, in cross section in the region of a cam ring.
Figure 2:
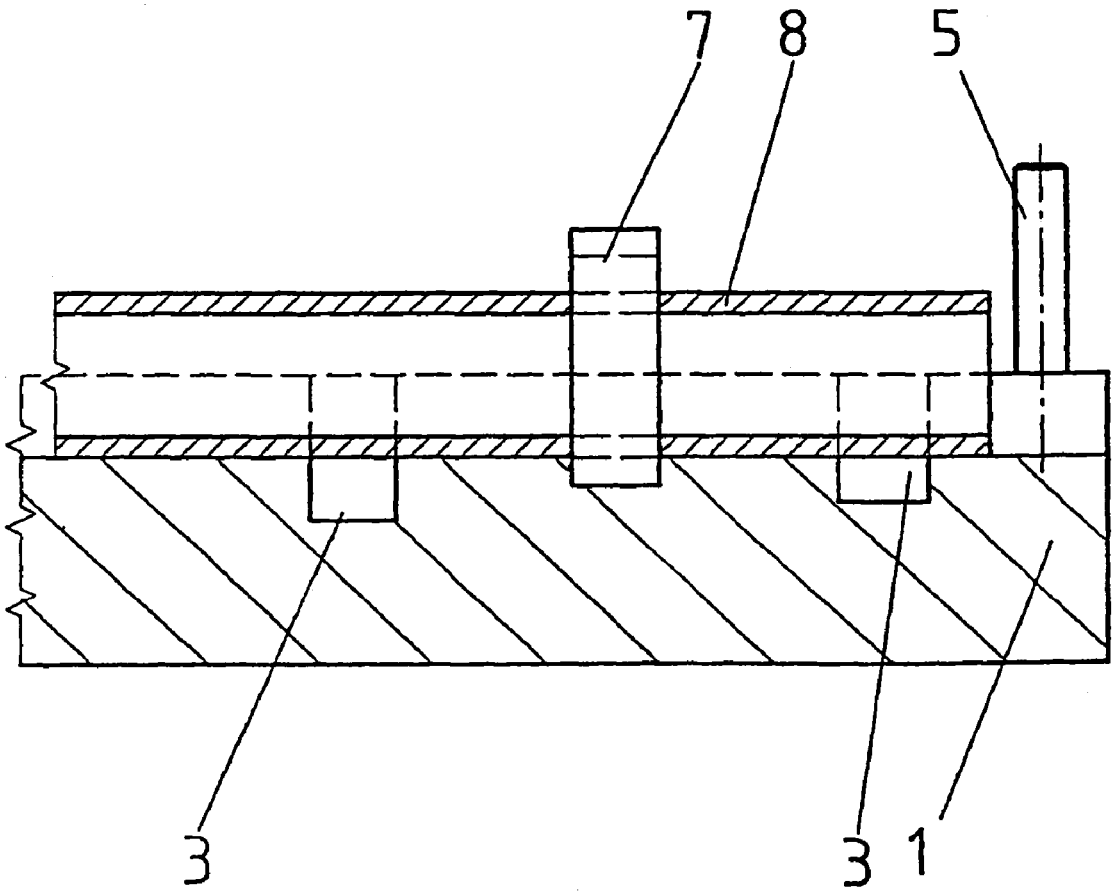
FIG. 2 shows a mounting device in longitudinal section A-A.

The mounting device comprises a lower part 1 and an upper part 2 and is illustrated in an open state in FIGS. 1 and 2. Mold nests 3, which are identical to the mold nests 3' in a lower die 4 and upper die (cf. FIG. 3) of a hydroforming press, are formed in these upper and lower parts. The two parts of the mounting device are fitted accurately above one another using locating pins 5 which latch into the bores 6. The mold nests 3 and 3' are machined out so as to correspond to the functionally related position and attitude of the cam rings 7 and hollow shaft 8. To hold the inserted parts, the hollow shaft 8, and, on it, the cam rings 7, in the correct angular position 7 after they have been put in place (in particular if the lower part 1 is removed in order for the loaded upper part 2 to be placed onto the lower die 4 of the hydroforming press), passages 9, which are connected to a vacuum generator via flexible hoses 10, are provided in the upper part 2 of the mounting device. The pressure reduction holds the parts immovably in their functionally appropriate position.

To convey the mounting device from the mounting position into the hydroforming press, there are guideways which run in guide grooves. Positioning elements 12 are provided for procedurally correct connection of the die to the upper and/or lower part (1, 2).

Figure 3:
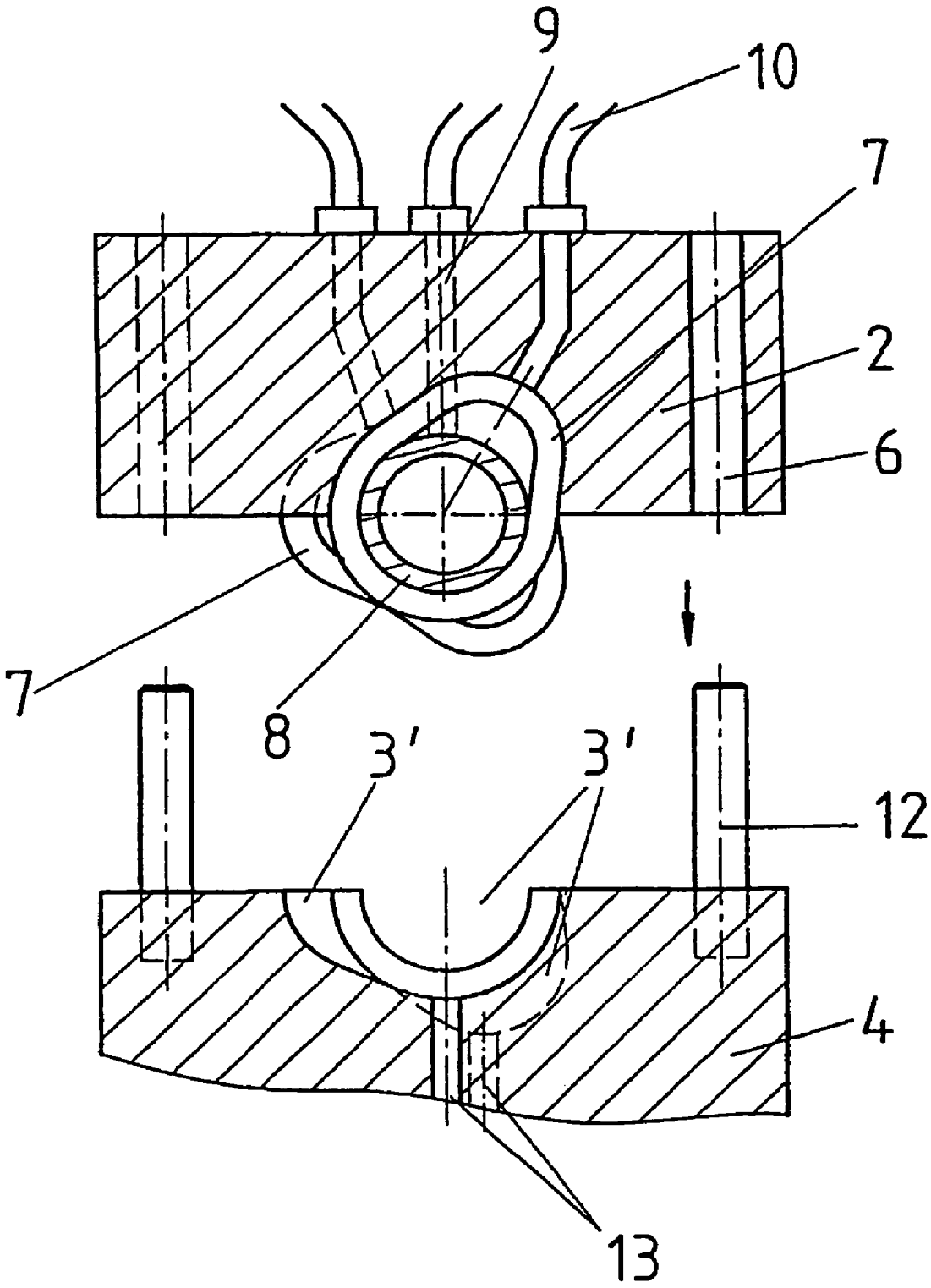
FIG. 3 shows a lower die of a hydroforming press with an upper part of the mounting device located above it.

In FIG. 3, the lower die 4 has not yet been loaded. The upper part 2 of the mounting device is already located above the lower die 4 in order to be lowered onto it. The hollow shaft 8 and the cam rings 7 are held in the upper part 2 by the pressure reduction. The upper part 2 is lowered, and accurate guidance, i.e. coinciding positioning, is ensured by the locating elements 12, which latch into the bores 6.

The method according to the invention is carried out as follows.

The cam rings 7 are introduced into the mold nest 3 in the lower part 1, on the hollow shaft 8, at a mounting station. In general, functionally accurate positioning is precisely ensured by means of the shapes of the recesses in the mold nest 3. In addition, a position check can be carried out by means of a suitable checking device. Then, the upper part 2 is slowly moved onto the lower part, guided by means of the locating pins 5 in the bores 6. This inevitably results in a further position check, since the upper part 2 can only be put into place if the cam rings 7 are accurately positioned. To prevent any change in position during the subsequent conveying of the mounting device into the hydroforming press (and also during placing of the mounting device onto the lower die 4), a pressure reduction, which applies suction to and holds in place the cam rings 7 and the hollow shaft 8 in the upper part 2, is generated via passages 9, hoses 10. When the mounting device is in the hydroforming press, above the lower die 4, the lower part 1 of the mounting device is lowered and moved out of the hydroforming press. The upper part 2 of the mounting device is lowered onto the lower die 4, with guidance from the positioning pins 12; the suction pressure is removed and the parts are then positioned in the lower die 4. The upper die moves downward onto the lower die 4, and the hydroforming process is carried out in a known way. Then, the hydroforming die is opened, and the finished camshaft is removed. In the meantime, the cam rings 7 are mounted on the hollow shaft 8 in a further mounting device, so that the latter can be moved into the hydroforming press.

The invention claimed is:

1. A method for making a workpiece, preferably a camshaft which comprises a hollow shaft and cam rings, from a plurality of parts connected to one another in a hydroforming process, the method comprising the steps of:

placing the parts of a workpiece into a lower part of a mounting device in a positionally and functionally correct manner, the mounting device comprising a lower part and an upper part, placing the upper part of the mounting device onto the lower part, fixing the parts in a predetermined position in the upper part of the mounting device by clamping and/or suction to load the upper part, moving the loaded upper part of the mounting device into an open hydroforming press having an upper die and a lower die, lowering the upper part of the mounting device, together with the parts which are held securely therein, into the lower die in a precisely defined position by means of positioning elements, releasing the clamps and/or lowering the suction pressure, the parts being held in the lower die in a positionally and functionally correct manner as a result of the lower die taking over the position-securing function, removing the upper part of the mounting device from the hydroforming press, closing the hydroforming press and carrying out the hydroforming process, and after termination of the hydroforming process removing the finished workpiece.

2. The method of claim 1, wherein upon placing the upper part of the mounting device onto the lower part a final check of the spatial and functionally correct position of the parts is carried out.

3. A method for making a workpiece, preferably a camshaft which comprises a hollow shaft and cam rings, from a plurality of parts connected to one another in a hydroforming process, the method comprising the steps of:

placing the parts of a workpiece into a mounting device in a positionally and functionally correct manner, fixing the parts in a predetermined position in the mounting device by clamping and/or suction to load the mounting device, moving the loaded mounting device into an open hydroforming press having an upper die and a lower die, placing the mounting device, together with the parts which are held securely therein, onto one of the lower die and the upper die in a precisely defined position, fixing the parts in the die by clamping and/or suction, and releasing the clamps and/or lowering the suction pressure in the mounting device, removing the mounting device from the hydroforming press, closing the hydroforming press and carrying out the hydroforming process, and after termination of the hydroforming process removing the finished workpiece.

4. The method of claim 3, wherein the mounting device comprises an upper and a lower part, and further wherein upon placement of the upper part onto the lower part, a check on the spatial and functionally correct position of the parts in the mounting device is carried out.

* * * * *